US009610624B2

(12) United States Patent
Jin et al.

(10) Patent No.: US 9,610,624 B2
(45) Date of Patent: Apr. 4, 2017

(54) METHOD FOR BENDING METAL SHEET AND DEVICE FOR REGULATING RESIDUAL STRESS

(75) Inventors: Yingjun Jin, Kanagawa (JP); Takahiro Shibata, Kanagawa (JP); Junichi Koyama, Kanagawa (JP); Hitoshi Omata, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 754 days.

(21) Appl. No.: 13/978,823

(22) PCT Filed: Jan. 13, 2012

(86) PCT No.: PCT/JP2012/050543
§ 371 (c)(1),
(2), (4) Date: Jul. 9, 2013

(87) PCT Pub. No.: WO2012/096362
PCT Pub. Date: Jul. 19, 2012

(65) Prior Publication Data

US 2013/0283875 A1 Oct. 31, 2013

(30) Foreign Application Priority Data

Jan. 14, 2011 (JP) ..... 2011-005649
Nov. 4, 2011 (JP) ..... 2011-242372

(51) Int. Cl.
*B21D 5/00* (2006.01)
*B21D 5/02* (2006.01)

(52) U.S. Cl.
CPC ..... *B21D 5/004* (2013.01); *B21D 5/008* (2013.01); *B21D 5/02* (2013.01)

(58) Field of Classification Search
CPC ..... B21D 5/008; B21D 5/01; B21D 5/004
See application file for complete search history.

(56) References Cited

U.S. PATENT DOCUMENTS 4,433,565 A * 2/1984 Preller ..... B21B 1/08 72/177
8,256,262 B2 9/2012 Matsui
(Continued)

FOREIGN PATENT DOCUMENTS

CN 101549367 10/2009
JP 02-147120 6/1990
(Continued)

OTHER PUBLICATIONS

ISR dated Apr. 14, 2012 (including English translation).
China Office action, mail date is Aug. 5, 2014.

*Primary Examiner* — Debra Sullivan
(74) *Attorney, Agent, or Firm* — Greenblum & Bernstein, P.L.C.

(57) ABSTRACT

A device for regulating a residual stress is comprised of: input means; a residual stress database; a process condition database; first searching means for searching a residual stress ($\sigma 0$) from the residual stress database; a calculator for calculating a first bending moment (Mrs) in a ridge line originated from the residual stress, and a second bending moment (Mz) in the ridge line originated from bending to obtain a total bending moment (Mrs−Mz) and calculating a camber curvature ($\rho z$) of the workpiece originated from the total bending moment (Mrs−Mz); comparing a difference ($|\rho z-\rho z0|$) between the camber curvature ($\rho z$) and a target value ($\rho z0$) with a tolerable value ($\rho$); second searching means for searching a process condition satisfying a tolerable condition ($|\rho z-\rho z0|\leq\rho$) from the process condition database when ($|\rho z-\rho z0|>\rho$); and regulating means for regulating a residual stress.

4 Claims, 10 Drawing Sheets

(56) References Cited

U.S. PATENT DOCUMENTS

| | | | |
|---|---|---|---|
| 8,413,480 | B2 | 4/2013 | Matsui |
| 2009/0241630 | A1 | 10/2009 | Matsui |
| 2012/0234071 | A1 | 9/2012 | Matsui |

FOREIGN PATENT DOCUMENTS

| | | |
|---|---|---|
| JP | 03-128125 | 5/1991 |
| JP | 07-116733 | 5/1995 |
| JP | 08-024954 | 1/1996 |
| JP | 08-090075 | 4/1996 |
| JP | 2004-098078 | 4/2004 |
| JP | 2005-177790 | 7/2005 |

* cited by examiner

METHOD FOR BENDING METAL SHEET AND DEVICE FOR REGULATING RESIDUAL STRESS

TECHNICAL FIELD

The present invention relates to a method for bending a workpiece mainly of a metal without cambering, and a device therefor.

BACKGROUND ART

Bending a workpiece of a thin sheet mainly of a metal sometimes results in formation of a camber along the bending ridge line. While leveling will be carried out by means of a device referred to as a leveler in a case where the degree of the camber exceeds a tolerable range, some workpieces, depending on shapes after bending, cannot pass through the leveler, or, even if they can pass through the leveler, requires a special die incorporated in the leveler. This is a factor that will decrease precision of the products or reduce productivity to a great extent.

The Patent Literatures 1-3 disclose related arts.

CITATION LIST

Patent Literature

[PTL 1]: Japanese Patent Application Laid-open No. H02-147120

[PTL 2]: Japanese Patent Application Laid-open No. H03-128125

[PTL 3]: Japanese Patent Application Laid-open No. 2005-177790

DISCLOSURE OF INVENTION

The present inventors have keenly studied factors that cause cambers to grow, and have found out that cutting before bending may often cause a relatively great residual stress in the vicinity of a cut edge, which affects a shape after bending. This invention has been reached on the basis of this discovery.

According to a first aspect of the present invention, a method for bending a workpiece having a flat plane and a cut edge is comprised of: regulating a residual stress in the workpiece in a range within a first width from the cut edge and not including a bending line; and bending the workpiece with the regulated residual stress along the bending line.

According to a second aspect of the present invention, a device for regulating a residual stress in a workpiece having a flat plane and a cut edge made by cutting is comprised of: input means for inputting information about cutting; a residual stress database relating a plurality of cutting conditions to residual stresses respectively resulted from the cutting conditions; a process condition database relating a plurality of process conditions for regulating residual stresses to residual stresses respectively resulted from the process conditions; first searching means for searching a residual stress ($\sigma 0$) from the residual stress database depending on the information; a calculator for calculating a first bending moment (Mrs) in a ridge line originated from the residual stress, and a second bending moment (Mz) in the ridge line originated from bending to obtain a total bending moment (Mrs−Mz) and calculating a camber curvature ($\rho z$) of the workpiece originated from the total bending moment (Mrs−Mz); comparing a difference ($|\rho z-\rho z0|$) between the camber curvature ($\rho z$) and a target value ($\rho z0$) with a tolerable value ($\rho$); second searching means for searching a process condition satisfying a tolerable condition ($|\rho z-\rho z0|\leq p$) from the process condition database in a case where the difference ($|\rho z-\rho z0|$) exceeds the tolerable value ($\rho$); and regulating means for regulating a residual stress in the workpiece in a range within a first width from the cut edge and not including a bending line on the basis of the searched process condition.

BEST MODE FOR CARRYING OUT THE INVENTION

Exemplary embodiments of the present invention will be described hereinafter with reference to the appended drawings.

Figure 8:
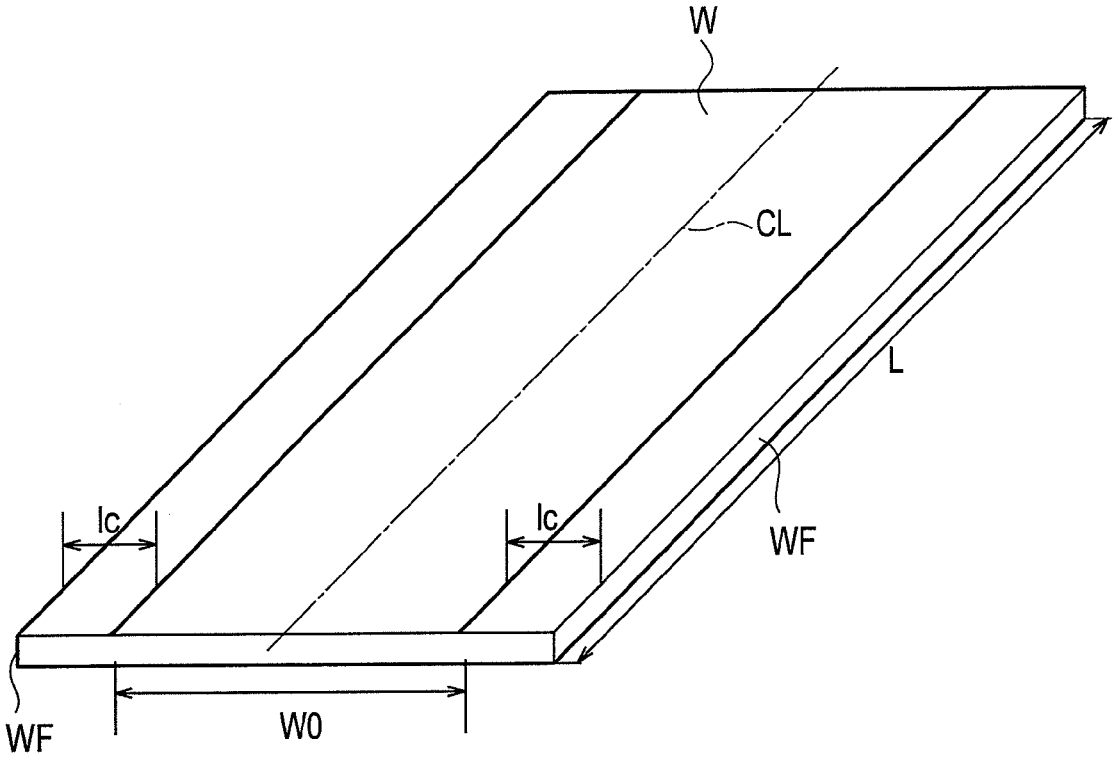
FIG. 8 is a perspective view showing an example of a workpiece before bending.

Bending is in general carried out in a procedure as described below. First, a thin sheet mainly of a metal is served to cutting by means of a shearing machine or a laser cutter, thereby forming a flat workpiece W as illustrated in FIG. 8. Bending is, for example, done by using a punch and a die having a shape adapted to a shape of a ridge after bending, placing the workpiece between the punch and the die, and then pressing them onto it. After bending, a ridge line will often be out of a straight line, then forming a camber. Cambers may present either a saddle camber shape as shown in FIGS. 3, 4C, 5 and 6 or a bow camber shape warped in opposite directions.

The present inventors have keenly studied factors that cause cambers to grow, and focused on influences of cutting methods thereon.

Cold rolled steel sheets of t=1.2 mm in thickness in compliance with an SPCC grade regulated in JIS-G3141 (corresponding to a CS grade regulated in ASTM-A1008) are cut out by means of a laser cutter, a shearing machine, and a wire-cutter, respectively, and are given 90 degrees U-bending respectively. Amounts of camber δw (mm) thereof are respectively measured. Lengths of the workpieces are l=400 mm, widths of bottom flanges after bending are fb=50 mm, and heights of flanges standing at both sides in the lateral directions are fs=7.5 mm. A definition of an amount of camber is compliant with that illustrated in FIGS. 3, 5 and 6, and measurement is done in regard to a plurality of sites at regular intervals in the longitudinal direction of the workpiece. Results are shown in FIG. 1.

Figure 1:
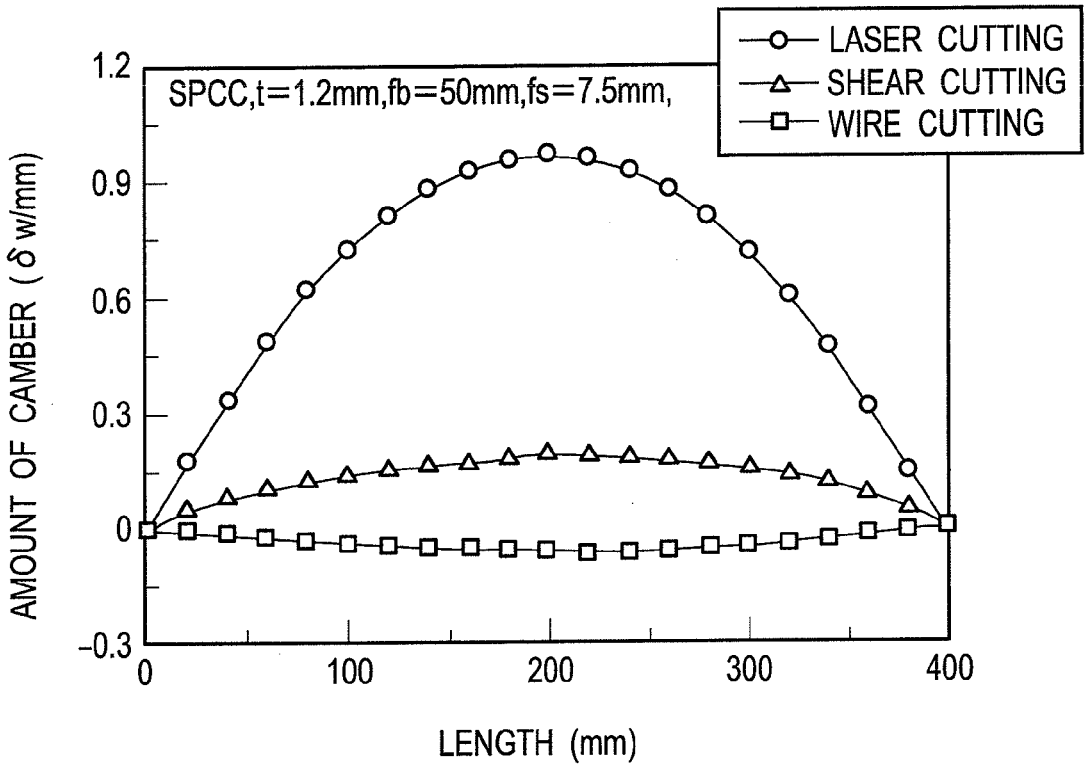
FIG. 1 is a graph showing results of measuring amounts of camber after bending, which shows that the amounts of camber depend on methods of cutting.

As being apparent from FIG. 1, bow cambers are formed in those produced via the laser cutter and the shearing machine, and a saddle camber is formed in that via the wire cutter. Further a far greater camber is formed in that via the laser cutter as compared with those via the other cutting machines.

Figure 2:
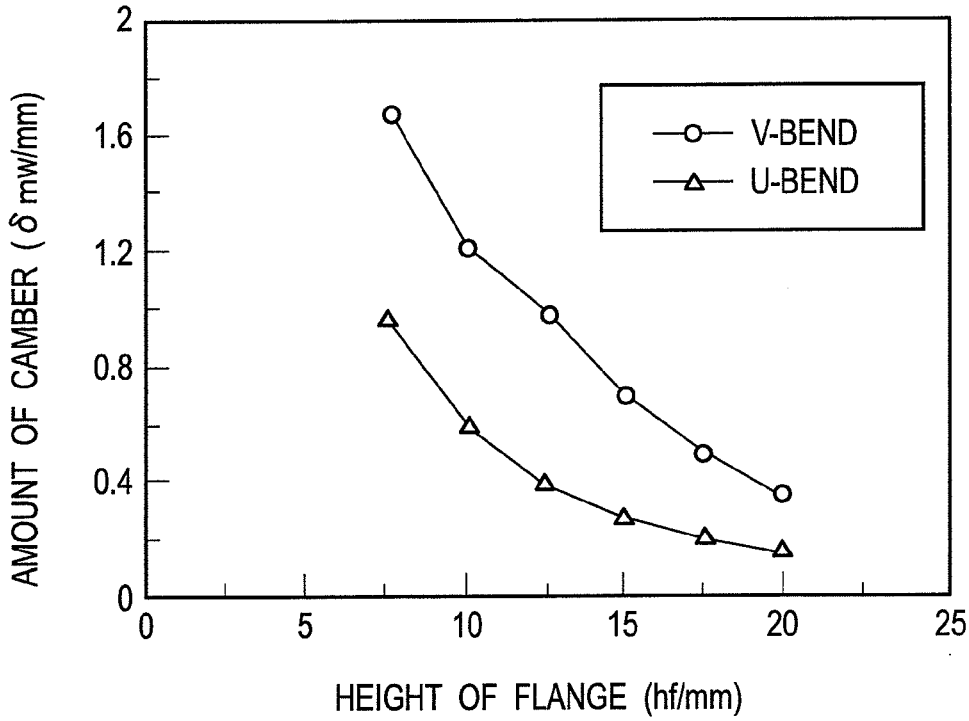
FIG. 2 is a graph showing results of measuring amounts of camber after bending, which shows that the amounts of camber depend on heights of flanges.

In FIG. 2 shown are results given from workpieces cut by the laser cutter, which are respectively V-bent and U-bent. A greater camber is acknowledged in the V-bent workpiece. Further, the greater the height of the flange, the smaller the amount of camber.

The aforementioned results could be accountable if it was interpreted that a stress remained in the vicinity of the cut edge after cutting and the residual stress acted on the ridge line, thereby resulting in camber forming after bending.

Figure 3:
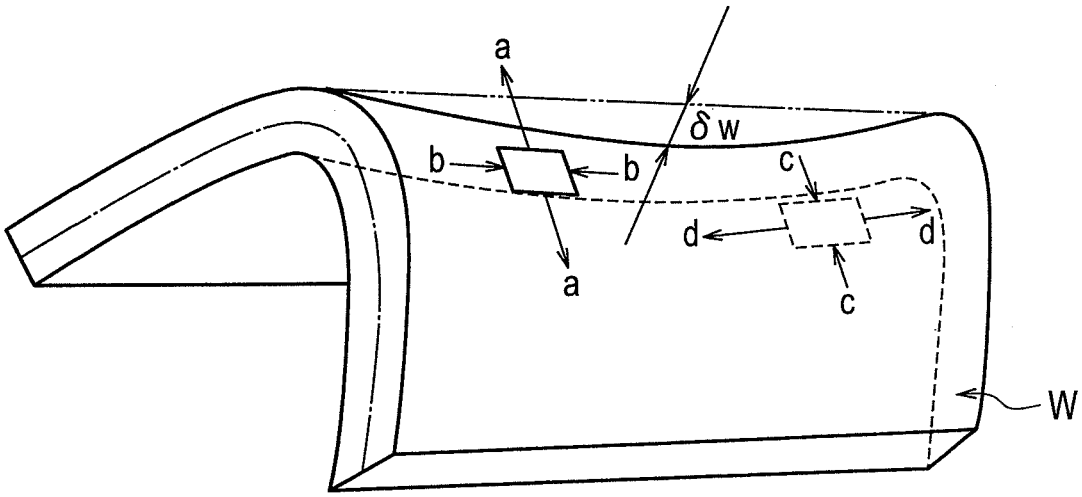
FIG. 3 is a schematic perspective view of a bent workpiece, which illustrates stresses around a ridge line.

Referring to FIG. 3, when a workpiece W is to be bent, in general, an outer plane must be elongated to a greater extent than a neutral plane does, and therefore a tensile strain is generated in an a-a direction on the outer plane. On the other hand, as a volume at issue is constant, a compressive strain is generated in a b-b direction perpendicular thereto. On the inner plane, to the contrary, a compressive strain is formed in a d-d direction and a tensile strain is formed in a c-c direction.

The compressive strain in the b-b direction on the outer plane and the compressive strain in the d-d direction on the inner plane are both strains warping the workpiece W along the ridge line, thereby resultantly generating a camber δ2 in FIG. 3.

On a ridge line of a workpiece W of a sheet shape, when being bent, its material is constrained from migrating along its ridge line is imposed on the material. Therefore a strain on a plane perpendicular to the ridge line is substantially a plane strain. In a case where the ridge line is directed in its longitudinal direction of the workpiece W, more specifically in a case where a camber fulfills a longitudinal camber, a geometrical moment of inertia is very small. Therefore, in a case where a workpiece W is a long matter and a longitudinal camber occurs, a camber δw is likely to become great.

Figure 4A:
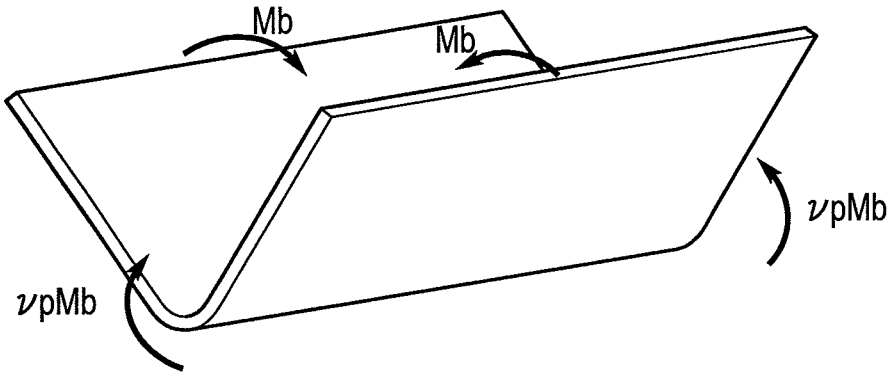
FIG. 4A is a schematic perspective view of the workpiece, which illustrates bending moments generated when a load acts on the workpiece so as to carry out bending.
Figure 4B:
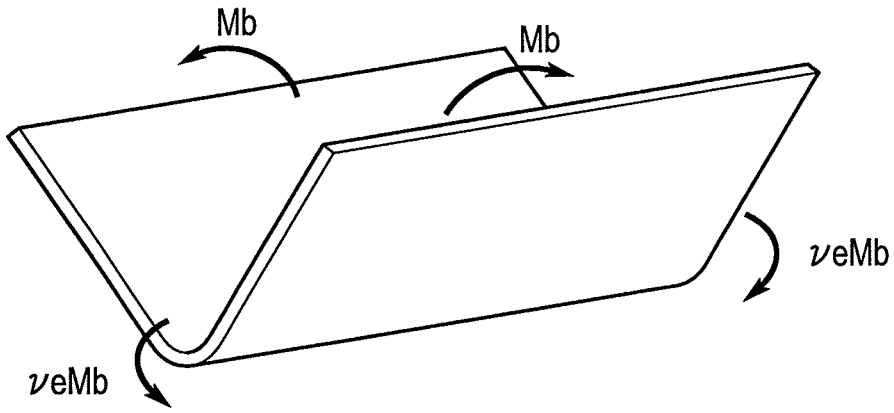
FIG. 4B is a schematic perspective view of the workpiece, which illustrates bending moments generated when unloaded after bending.
Figure 4C:
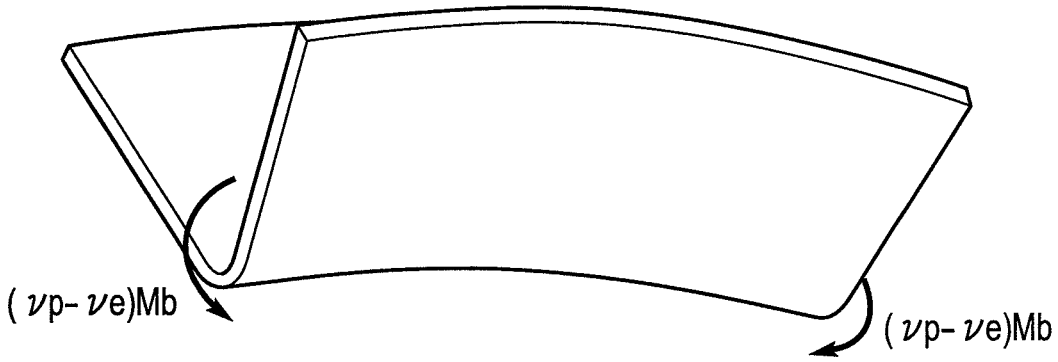
FIG. 4C is a schematic perspective view of the workpiece, which illustrates bending moments resultantly left therein after loading and unloading.

Referring to FIG. 4A, assuming that a strain is a plane strain, when a workpiece W is bent by a moment Mb, a bending moment νp·Mb acts on its ridge line, where νp represents a plastic Poisson ratio. Referring to FIG. 4B, when unloading after bending, as this is corresponding to giving a bending moment with the same amount as the aforementioned bending moment Mb but in a direction opposite thereto so as to reduce it down to zero, a bending moment νe·Mb acts on the ridge line, where νe represents an elastic Poisson ratio. Because the plastic Poisson ratio and the elastic Poisson ratio generally differ from each other, in total, a bending moment (νp−νe)Mb is generated along the ridge line as shown in FIG. 4C after unloading.

Figure 5:
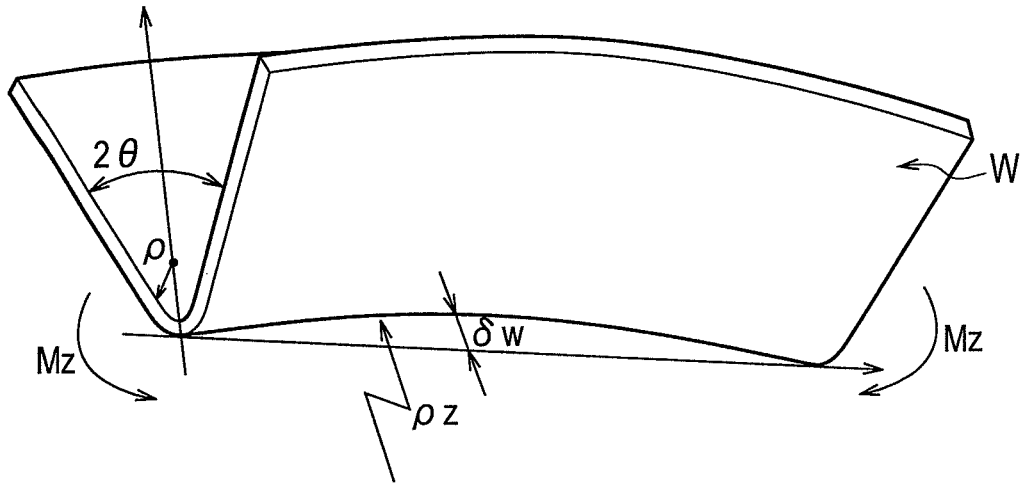
FIG. 5 is a schematic perspective view of the workpiece after bending for illustrating respective parameters.

Referring to FIG. 5, V-bending with a bending angle of 2θ is assumed. It is assumed a case where a bending moment (νp−νe)Mb in a longitudinal direction along a ridge line of a workpiece W is generated and its component Mz in the perpendicular direction acts on the ridge line to generate a camber. If the bending moment (νp−νe)Mb uniformly acts on a bent region after unloading, the bending moment Mz is equal to an integral of components in the neutral axis direction and therefore it is given by the following equation.

$$\begin{aligned} Mz &= 2\int_0^{\theta}(v_p - v_e)M\rho\cos\phi\, d\phi \\ &= 2(v_p - v_e)M\rho\sin\phi \end{aligned} \tag{1}$$

A curvature 1/ρz brought about by the bending moment Mz is represented by:

$$\frac{1}{\rho_z} = \frac{M_z}{EI_z}, \tag{2}$$

where ρz represents a radius of curvature, E represents a Young's modulus, and Iz represents a geometrical moment of inertia.

When a bending moment Mz acts on a workpiece W having a length L, a relation between an amount of camber δw and a radius of curvature ρz at a center of a ridge line of the workpiece W can be represented by the following equation. This is, however, an approximation using a fact that L/2ρz is very small as compared with 1.

$$\delta_w = \rho_z(1-\cos(l/2\rho_z)) \tag{3}$$

As a length is constant in the neutral plane, a relation of curvatures is given by the following equation.

$$\left(\frac{1}{\rho'} - \frac{1}{\rho_0}\right) = \frac{\Delta\theta}{\rho\theta} \tag{4}$$

On the basis of these equations (1)-(4), an amount of camber δw can be represented by the following equation.

$$\delta_w = \frac{v_p - v_e}{48(1 - v_e^2)} \cdot \frac{t^3 l^2}{I_z} \cdot \frac{\sin\theta}{\theta}\Delta\theta \tag{5}$$

Here, Δθ is corresponding to a springback occurred after unloading. To make the amount of camber δw be not 0, more specifically to generate the camber, it is necessary to make the springback Δθ be not 0. Further, if the plastic Poisson ratio νp is equal to the elastic Poisson ratio νe, the amount of camber δw comes to be 0 regardless of the value of the springback Δθ, thereby any camber does not come out.

In the meantime, the plastic Poisson ratio νp can be represented by the following equation with using a Lankford value r.

$$\nu_p = \frac{r}{1+r} \tag{6}$$

As will be understood from the equation (6), a material with a smaller Lankford value r leads to a smaller Poisson ratio νp, thereby forming a smaller camber as being understood with reference to the equation (5).

By the way, as discussed before, one of the problems in shape precision after bending is a residual stress around a cut edge. When a residual stress is generated around a cut edge of a workpiece W, a bending moment Mrs generated by the residual stresses is superimposed on a bending moment Mz, thereby transforming the camber.

When a total moment is represented by M;

$$M = Mrs - Mz \tag{7}$$

Therefore, a saddle camber comes out when M<0, a bow camber comes out when M>0, and any camber does not come to be when M=0. Further, the following equation holds.

$$\left(\frac{1}{\rho'} - \frac{1}{\rho_0}\right) = \frac{12(1-\nu^2)}{Et^3} M_z \tag{8}$$

The equations (1), (4) and (11) lead to:

$$M_z = \frac{(\nu_p - \nu_e)}{6(1-\nu_e^2)} Et^3 \frac{\Delta\theta}{\theta} \sin\theta \tag{9}$$

$$\frac{1}{\rho_z} = \frac{M_{rs} - M_z}{EI_z} \tag{10}$$

$$\delta_w = \frac{l^2}{8\rho_z} \tag{11}$$

When a residual stress σ generated after cutting is considered as a function σ(1) of a distance l from the cut edge, a bending moment Mrs generated by the residual stresses is represented by the following equation.

$$dM_{rs} = \sigma(l)t[(f_s - l)\cos\theta - e]dl$$

$$M_{rs} = 2\int_0^{f_s} \sigma(l)t[(f_s - l)\cos\theta - e]dl \tag{12}$$

Here e in the equation (12) is a distance in the direction along the X-axis between a center of gravity when the workpiece W is subject to V-bending around the Y-axis and the neutral axis of the workpiece W.

We have studied a distribution of residual stresses that a laser cutter leaves in a cut edge. We have cut a cold rolled steel sheet of t=1.2 mm in thickness compliance with an SPCC grade regulated in JIS-G3141 (corresponding to a CS grade regulated in ASTM-A1008) with a carbon dioxide continuous laser cutter with a output power capacity of 2.7 kW at a cutting rate of 83 mm/s. Nitrogen at 0.8 MPa is used as an assist gas. The laser is focused on a surface of the workpiece. A measured distribution of residual stresses is shown in FIG. 7.

Measurement of residual stresses after cutting has been done by carrying out wire-cutting on the workpiece and measuring a strain generated by resultant release of a residual stress. We have carried out wire-cutting at proper intervals from the cut edge and, in each occasion, measured a residual stress. The horizontal axis in FIG. 7 represents distances from the cut edge and the vertical axis represents residual stresses where positive values mean tensile stresses.

Figure 7:
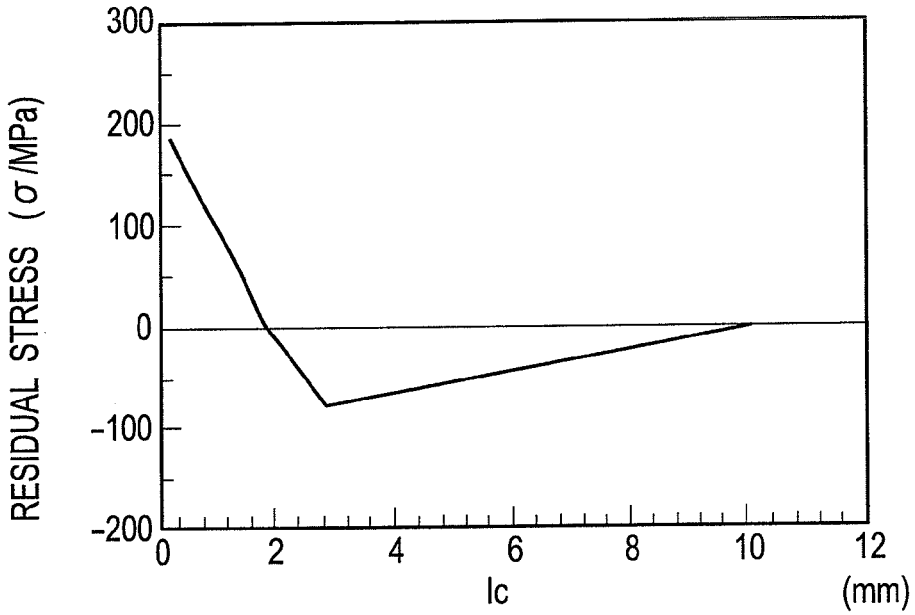
FIG. 7 is a graph showing an example of a relation between distances from a cut edge and residual stresses.

As being apparent from FIG. 7, the residual stresses are positive closely around the cut edge, and therefore relatively great tensile stresses can be acknowledged. Where considerably distant from the cut edge (2 mm or more in this case), the residual stresses turn to be negative, and therefore compressive stresses can be acknowledged. Where sufficiently distant from the cut edge (10 mm or more in this case), the residual stresses asymptotically approach to zero.

Figure 9:
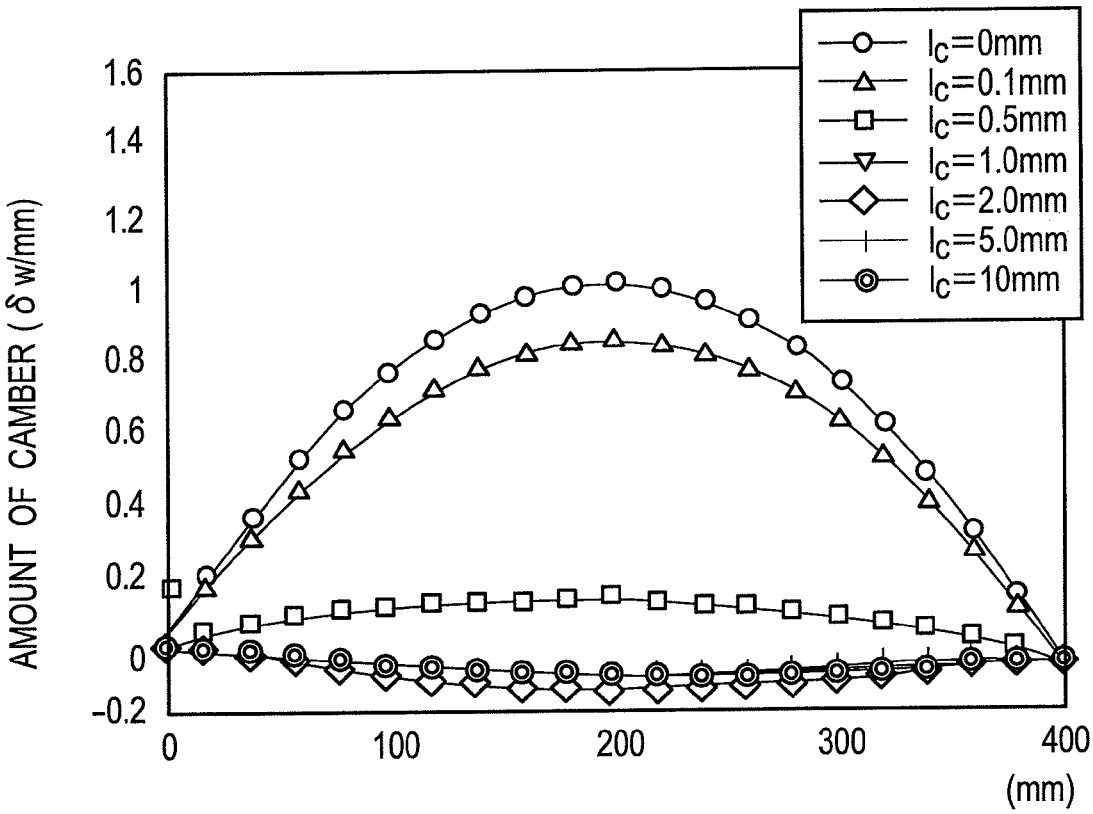
FIG. 9 is a graph showing results of measuring amounts of camber after bending, which shows a relation between widths, residual stresses of which are to be regulated, and amounts of camber.

A plurality of test pieces of the same cold rolled steel sheets have been subject to laser-cutting in the same condition as that described above. These test pieces have been, as shown in FIG. 8, cut at distances lc (0 mm, 0.1 mm, 0.5 mm, 1.0 mm, 2.0 mm, 5.0 mm, 10.0 mm) from the cut edges by wire-cutting respectively. They have been bent at 90 degrees at the chain lines CL (lateral centers) respectively, and amounts of camber δw have been measured at ridge lines (originally, the chain lines). Results are shown in FIG. 9.

In the test piece of lc=0 mm (more specifically, as laser-cut), the residual stress by laser-cutting are not removed at all. The amounts of camber δw are positive (bow camber), and the greatest among those of all the test pieces. In the test piece of lc=0.1 mm, as being understood from FIG. 7, removal of the residual stress is slight. The amounts of camber δw in this test piece are relatively great, next to those of lc=0 mm, and reach 0.8 mm at its maximum. In the test piece lc=0.5 mm, the amounts of camber δw are prominently reduced down to 0.15 mm at its maximum and therefore the effect of removal of the residual stress is acknowledged to be prominent. In the test pieces of lc=1 mm or more, the amounts of camber δw are negative (saddle camber) in any case.

More specifically, it is apparent that the residual stresses around the cut edge of the workpiece affects camber formation after bending. Further, to suppress bow-cambering in a workpiece, it is understood that regulating (ordinarily, reducing) the residual stress around the cut edge is preferable. More specifically, one of the problems in shape precision is a residual stress around a cut edge and the respective embodiments described below have been reached on the basis of a discovery of this source of the problem.

As being apparent from the aforementioned discussion, in a case where a residual stress is left around the cut edge, applying a compression stress makes it possible to convert the shape after bending, which is to be a saddle camber, into a bow chamber.

Figure 6:
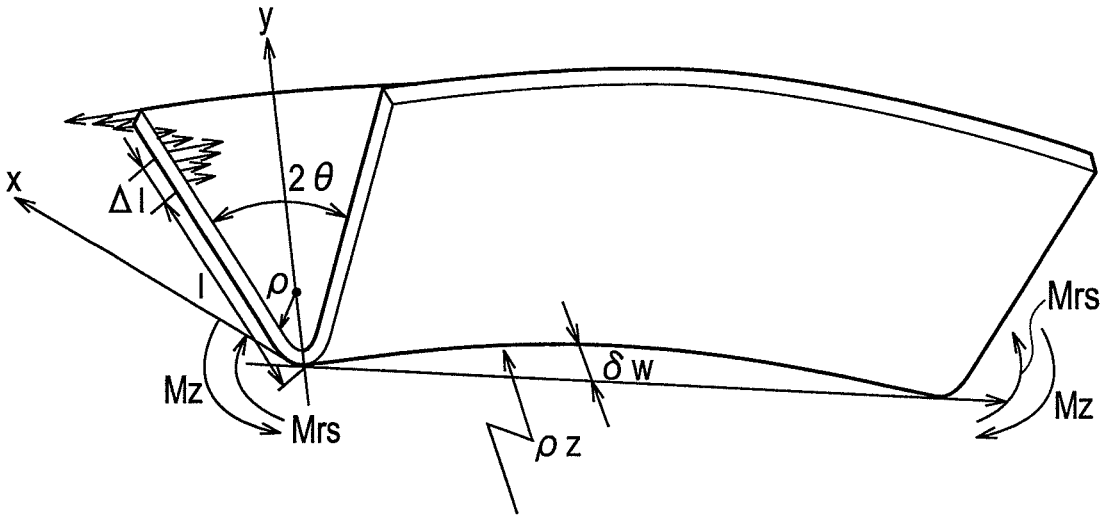
FIG. 6 is a schematic perspective view of the workpiece after bending for illustrating influences of residual stresses around a cut edge.

As being already discussed with reference to FIG. 6, a total moment M=Mrs−Mz as a sum of a bending moment Mz generated by bending and a bending moment Mrs induced by the residual stresses acts on the ridge line to bring about the camber. In a case where this has a positive value (more specifically, Mrs is greater than Mz), a bow camber is generated, and in a case where this has a negative value (more specifically, Mrs is smaller than Mz), a saddle camber is generated. In the present embodiment, a residual stress will be regulated to cause a desired camber, or let the degree of the camber within a tolerable range.

Figure 10A:
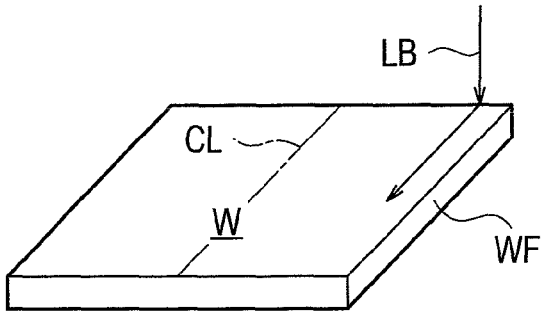
FIG. 10A is a schematic perspective view showing an example in which heating by laser irradiation is used to regulate residual stresses.

A device for regulating a residual stress in a workpiece is comprised of any means for regulating a residual stress. One of such means is, referring to FIG. 10A for example, a device for irradiating a laser beam LB around a cut edge WF of a workpiece W to heat it. Heating cancels, or reduces, the residual stress. Whereas a laser beam is preferable in light of local heating, any local heating means such as a carbon heater or an induction heating device may be instead applied thereto. Alternatively, if possible, a total heating means such as a gas burner or a heating furnace may be used.

Figure 10B:
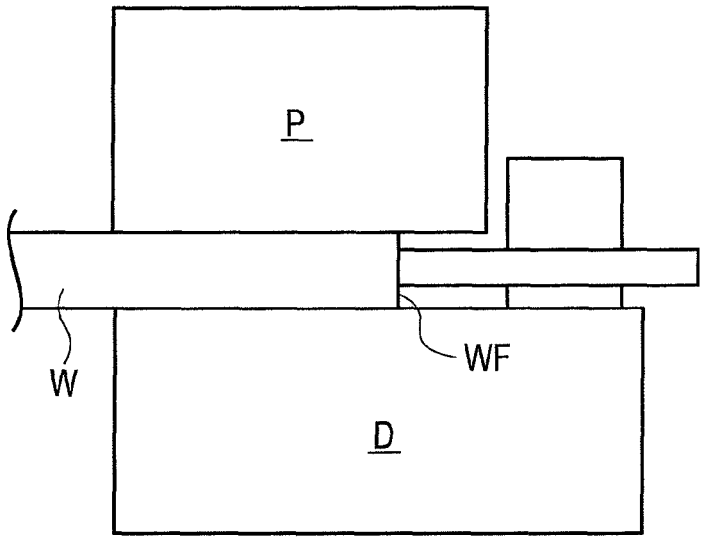
FIG. 10B is a schematic perspective view showing an example in which applying pressure by a punch and a die is used to regulate residual stresses.

Another example of a means for regulating a residual stress is a punch P and a die D, which are capable of applying pressure as shown in FIG. 10B. A workpiece W is placed on the die D and is given pressure by the punch P. Actuation of the punch P is made by a hydraulic device for example. As a residual stress is in general a tensile stress, applying a compressive stress to balance therewith cancels, or reduces, the residual stress.

Figure 10C:
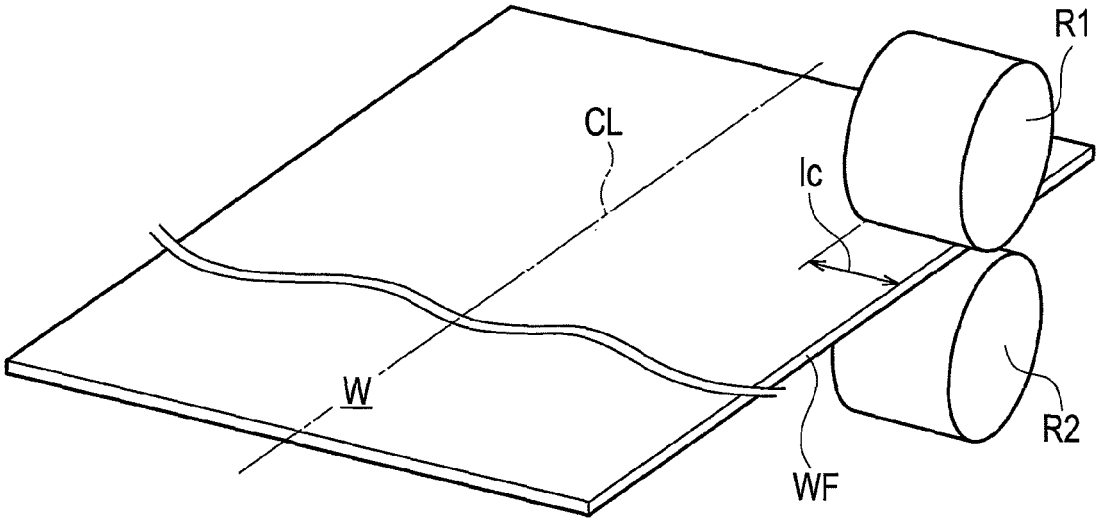
FIG. 10C is a schematic perspective view showing an example in which applying pressure by rollers is used to regulate residual stresses.

Still another example of a means for regulating a residual stress is rollers R1, R2 which are capable of applying pressure as shown in FIG. 10C. A workpiece W passes through the rollers R1, R2 driven by any pressurizing means such as hydraulic devices or any equivalences and is then given pressure. As described above, the residual stresses are canceled, or reduced, by pressurizing.

Or, if possible, any proper means is applicable.

What is subject to regulation of a residual stress is a range having a considerable width from the cut edge WF, which does not include the bending line CL (i.e., also referred to as chain line). This width is preferably brought into conformity with a range where a tensile residual stress is left, and may be, with reference to FIG. 7, set to be longer than 0.1 mm and shorter than 10 mm. Further the regulating means may be comprised of a gauge as shown in the right of FIG. 10B for example, so as to limit a width in such a range. What is subject to regulation of a residual stress may be one of edges, or a pair of opposite edges, of the workpiece W.

In a case where the opposite edges are subject to regulation of a residual stress, conditions for regulating a residual stress may be distinct, or identical, between the edges. In the example of FIG. 10C for example, the pressure force by the rollers R1, R2 onto the right edge may be distinct from that onto the left edge. Further the widths lc may be distinct between the left edge and the right edge. Further changes to the pressure force along the longitudinal direction may occur.

Whichever a material is applied to a workpiece W, generally a yield point can be known in advance. The pressure force may be determined so as to apply a stress slightly greater than the yield point. As the border of the cut edge produces plastic deformation and thereby receives a compressive stress, this means is prominently effective in regulating a residual stress.

Alternatively, a stress slightly smaller than the yield point may be applied. Further, by applying a stress for a long time period, a creep strain may be given thereto. Either case is effective in regulating a residual stress.

Figure 11:
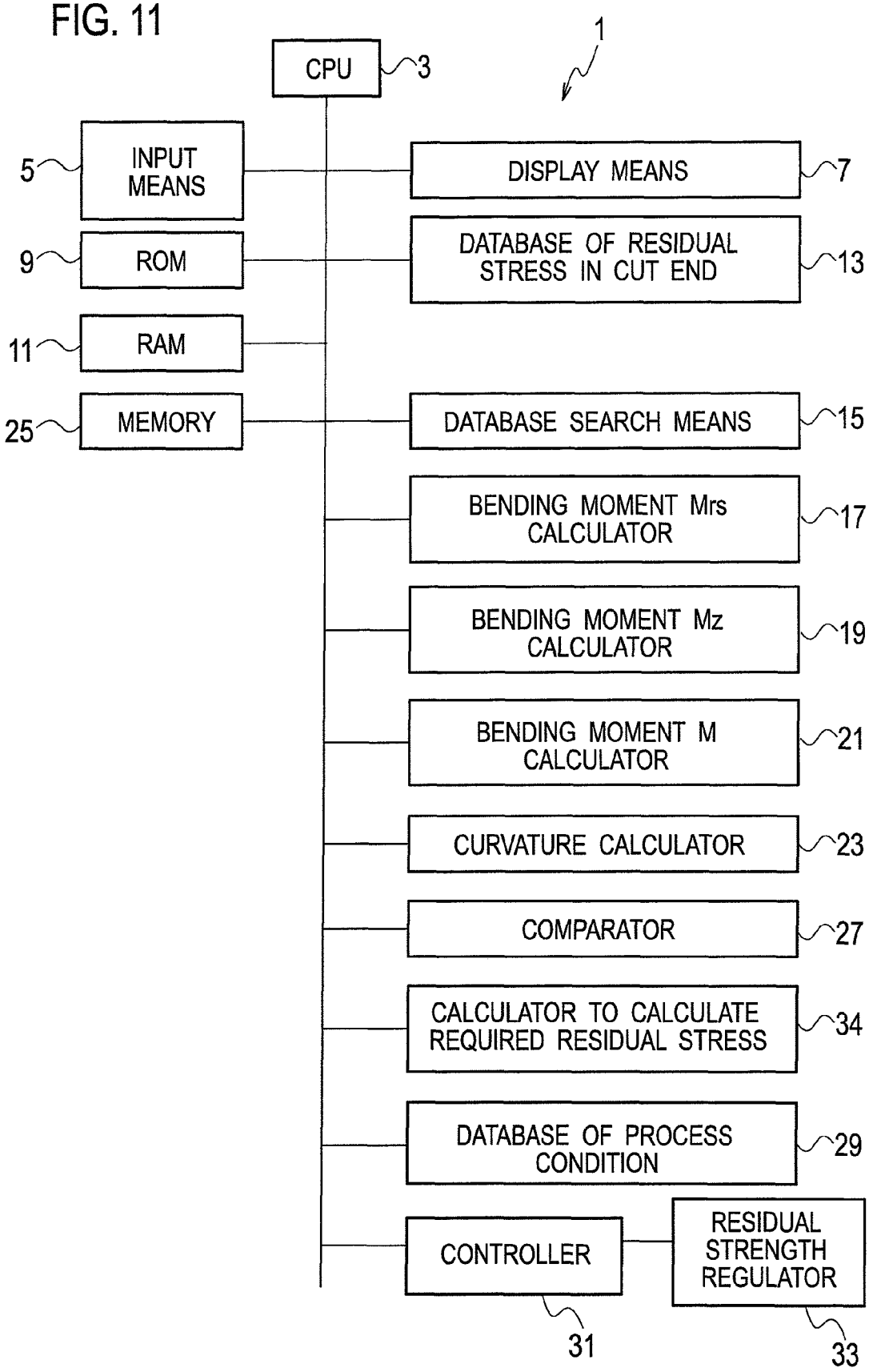
FIG. 11 is a block diagram of a device for regulating residual stresses in a workpiece having a cut edge.

Referring to FIG. 11, the device 1 for regulating a residual stress in a workpiece is, in addition to the aforementioned regulating means, comprised of a central processing unit (CPU) 3, an input means 5, a display means 7, a read-only memory (ROM) 9, a random access memory (RAM) 11, a database of residual stresses 13, a database search means 15, calculators 17, 19, 21, 23, 27, 34, a database of process conditions 29, a controller 31, and a regulating means for regulating a residual stress 33. The database search means 15 and calculators 17, 19, 21, 23, 27, 34 may be either part of the CPU 3 or independent hardware units.

The database of residual stresses 13 includes data in which a plurality of cutting conditions are respectively related to resultant residual stresses.

The cutting conditions include materials, sheet thicknesses, and cutting methods to be used. Further, in a case of cutting by a laser, the data include various conditions such as laser powers and cutting speeds. In a case of cutting by shearing, the data include shearing angles and clearances.

The data of residual stresses include a function $\sigma=\sigma(l)$, in which values of residual stresses are related to distances from a cut edge.

The database of residual stresses 13 is constructed by cutting in various cutting conditions in advance and measuring resultant residual stresses, and is stored in a proper storage device in advance.

The database search means 15 has a function of searching and reading out an optimal data from the database of residual stresses in accordance with a cutting condition input through the input means 5.

The calculator 17 calculates a moment Mrs by means of an equation (13) in accordance with the read out function $\sigma=\sigma(l)$ of a residual stress distribution.

$$Mrs=2\int\sigma(y)f(y)tdy \tag{13}$$

This is, however, applicable to a case of V-bending. Further the calculator 17 may further have a function of calculating a residual stress distribution a from a given Mrs.

The calculator 19 calculates the bending moment Mz by means of the equation (1) in accordance with the information about bending (a bending angle and a bending radius for example) input through the input means 5. The calculator 21 calculates the moment M from Mrz and Mz by means of the equation (7). The calculator 23 calculates the camber curvature $\rho z$ by means of the equation (10).

The memory 25 stores a target value $\rho z0$ in advance, and the calculator 27 calculates a difference $|\rho z-\rho z0|$ between the calculated camber curvature $\rho z$ and the target value $\rho z0$. Alternatively any other means may calculates the difference $|\rho z-\rho z0|$.

The memory 25 further stores a tolerable value $\rho$. The calculator 27 compares $\rho$ with $|\rho z-\rho z0|$. It is determined that there will be no problem when $\rho\geq|\rho z-\rho z0|$ because an amount of camber is expected to stay within the tolerable value. It is determined that regulation of a residual stress is necessary when $\rho<|\rho z-\rho z0|$ because an amount of camber is expected to go beyond the tolerable value.

The process condition database 29 is used for calculating a condition for regulating a residual stress. The process condition database 29 includes data in which a plurality of process conditions for regulating residual stresses are respectively related to resultant residual stresses.

The process conditions include materials, sheet thicknesses, and processes to be applied. Further, in a case of regulating a residual stress by a laser beam, the process condition database 29 includes data in which laser powers, moving speeds of the laser beams, and distances from a laser oscillator to a workpiece are mutually related.

Further in a case of using a punch and a die to regulate residual stresses, the data include data of pressure forces by the punch, pressure cycles, and feeding speeds of a workpiece. In a case of using rollers, the data include data of pressure forces by the rollers, and feeding speeds of a workpiece.

The process condition database 29 is constructed by carrying out experiments to collect data in advance.

In a case where the calculator 27 determines $\rho<|\rho z-\rho z0|$, the database search means 15 searches and reads out a condition to realize $\rho\geq|\rho z-\rho z0|$ from the process condition database 29.

The controller 31 controls the regulating means 33 in accordance with the read-out process condition to regulate a residual stress around a cut end of a workpiece.

Figure 12:
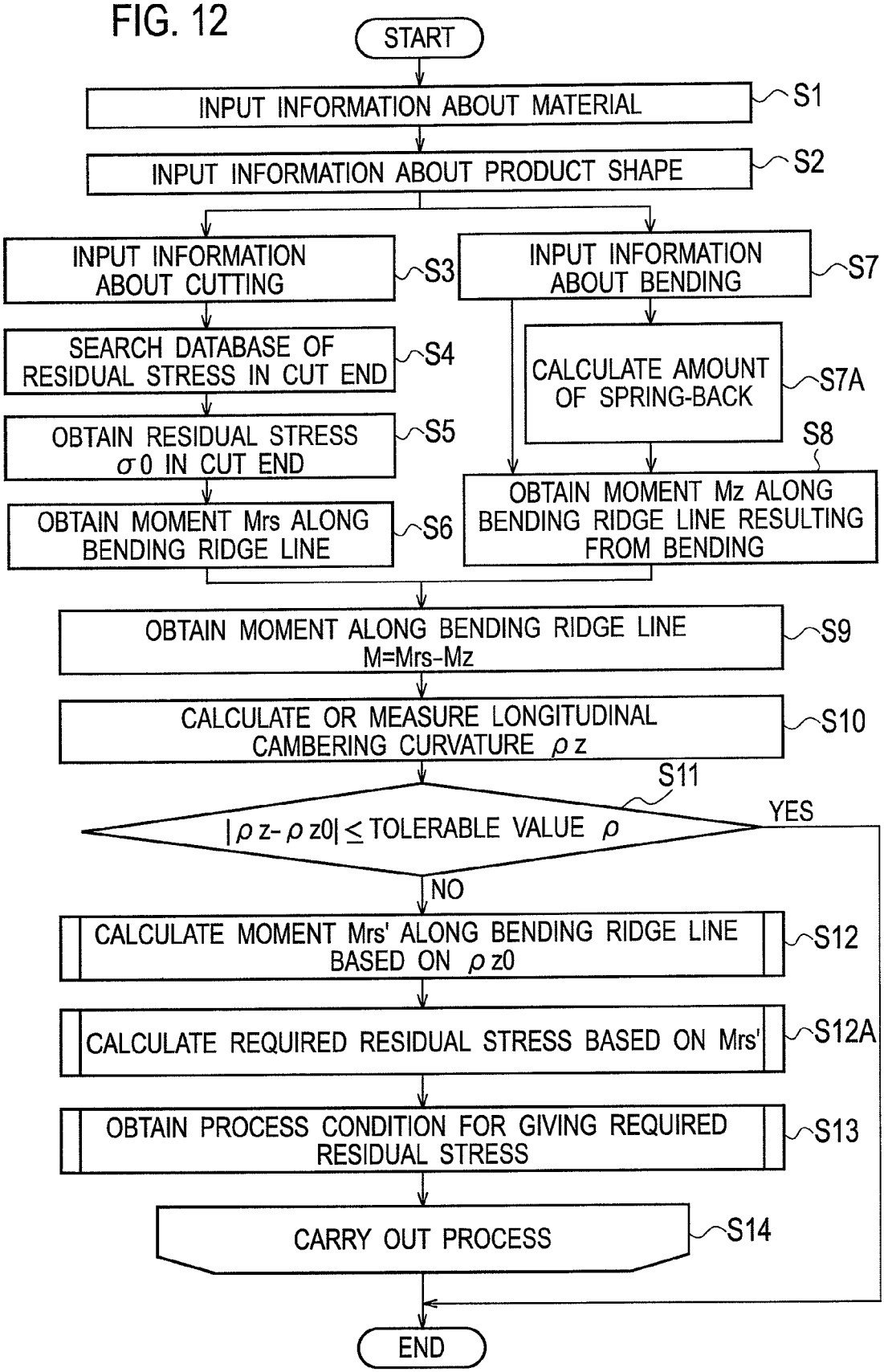
FIG. 12 is a flowchart for regulating residual stresses in a workpiece having a cut edge.
Figure 13:
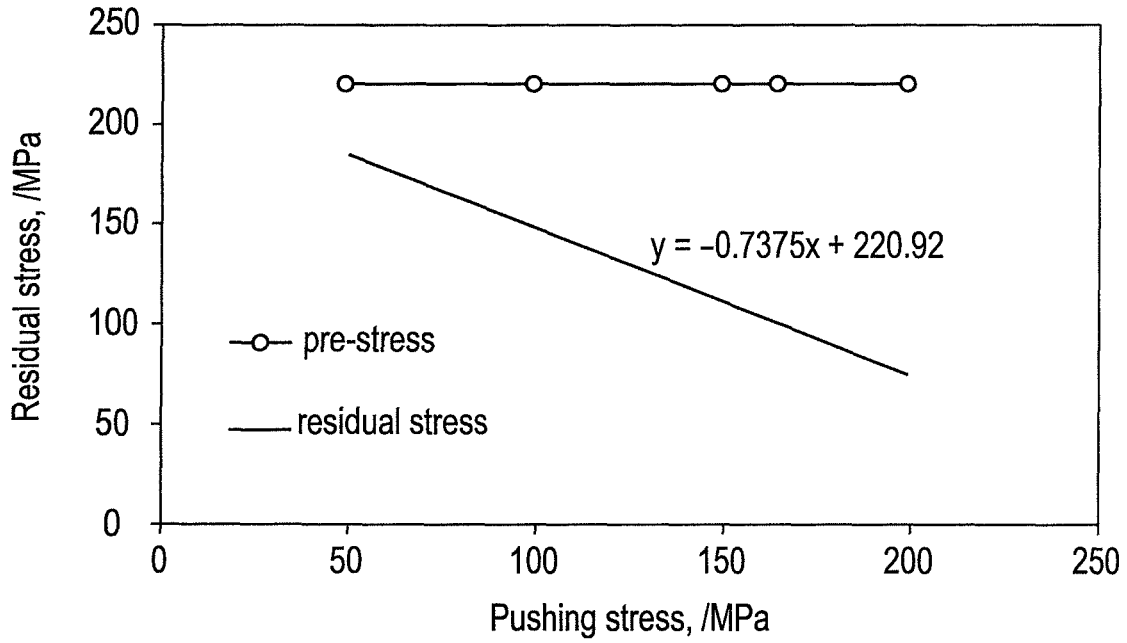
FIG. 13 is a graph for illustrating a process condition database.

Referring to FIG. 12, a residual stress is regulated in a way described below by means of the device 1 for regulating a residual stress of a workpiece.

Information about a material, a thickness, and such, of a workpiece W is input through the input means 5 to the device 1 (step S1), and information about a shape of a product is input through the input means 5 to the device 1 (step S2). The shape of the product includes a bending angle, dimensions of a flange and such.

Next a condition of cutting is input (step S3), and a residual stress data is read out by the database search means 15 in accordance with the cutting condition (steps S4 and S5). A moment Mrs is calculated by the calculator 17 in accordance with the read-out residual stresses a around the cut edge (step S6).

Further information about bending is input through the input means 5 (step S7). This information includes, a radius and an angle of a tip end of the punch, a radius and an angle of the die, a radius of a shoulder of the die. The calculator 19 calculates a bending moment Mz generated along the ridge line in accordance with the input information (step S8). The calculator 23 calculates a camber curvature $\rho z$ from the calculated Mrs and Mz (step S10). An amount of camber $\sigma w$ can be calculated by using this and by the equation (11).

Next the calculator 27 uses $\rho z0$ stored in the memory 25 in advance to calculate $|\rho z-\rho z0|$, and compares p with $|\rho z-\rho z0|$ (step S11). When $\rho\geq|\rho z-\rho z0|$ (YES in the step S11), the process is finished and then moves to a bending process.

When $\rho<|\rho z-\rho z0|$ (NO in the step S11), the calculator 34, on the basis of $\rho z0$, calculates Mrs' by the equation $Mrs'=Mz+El/\rho z0$ (step S12). Meanwhile this equation is inherently led out of the equation (10). Next the calculator 34, on the basis of calculated Mrs', calculates target residual stresses by the equation (13), and, on the basis of the calculated target residual stresses, calculates a necessary process condition (step S12A). In this calculation, any known method such as an FEM analysis or such is used.

The database search means 15 searches and reads out an optimal process condition from the process condition database 29 (step S13). The controller 31 controls the regulating means 33 to regulate residual stresses around the cut edge of the workpiece in accordance with the process condition (step S14). The method of regulation is already described before.

When finishing the steps described above, the process moves to a bending step. Bending that is done through the process realizes a shape satisfying a predetermined precision.

Although the invention has been described above by reference to certain embodiments of the invention, the invention is not limited to the embodiments described above. Modifications and variations of the embodiments described above will occur to those skilled in the art, in light of the above teachings.

INDUSTRIAL APPLICABILITY

Bending satisfying a predetermined precision is realized.

The invention claimed is:

1. A method for bending a workpiece having a flat plane and a cut edge, the method comprising:

regulating a residual stress in the workpiece in a range within a first width from the cut edge and not including a bending line;

bending the workpiece with the regulated residual stress along the bending line;

calculating a first bending moment (Mrs) in a ridge line originated from the residual stress, and a second bending moment (Mz) in the ridge line originated from bending to obtain a total bending moment (Mrs−Mz);

calculating a camber curvature ($\rho z$) of the workpiece originated from the total bending moment (Mrs−Mz); and wherein the regulating the residual stress in the workpiece in the range within the first width from the cut edge and not including the bending line is performed so as to make a difference between the camber curvature ($\rho z$) and a target value ($\rho z0$) be equal to or less than a tolerable range.

2. The method of claim 1, wherein, in the regulating the residual stress, any selected from the group consisting of pressurizing and heating is applied to the workpiece.

3. The method of claim 1, wherein the first width is longer than 0.1 mm and shorter than 10 mm.

4. The method of claim 2, wherein the first width is longer than 0.1 mm and shorter than 10 mm.

* * * * *